US006746299B1

(12) United States Patent
Graf

(10) Patent No.: US 6,746,299 B1
(45) Date of Patent: Jun. 8, 2004

(54) INFANT-OPERABLE REMOTE CONTROLLED ENTERTAINMENT AND EDUCATION DEVICE AND SYSTEM

(76) Inventor: David Graf, 5 Sand Oaks Rd., Laguna Niguel, CA (US) 92677

( * ) Notice: Subject to any disclaimer, the term of this patent is extended or adjusted under 35 U.S.C. 154(b) by 0 days.

(21) Appl. No.: 10/313,545

(22) Filed: Dec. 6, 2002

(51) Int. Cl.[7] ..... A63H 33/00
(52) U.S. Cl. ..... 446/227
(58) Field of Search ..... 446/227, 454, 446/456, 491

(56) References Cited

U.S. PATENT DOCUMENTS

| | | | | |
|---|---|---|---|---|
| 3,004,353 A | * | 10/1961 | Klamer et al. | 434/259 |
| 3,538,620 A | * | 11/1970 | Kohner et al. | 434/258 |
| 3,893,257 A | * | 7/1975 | Miki | |
| 4,229,903 A | * | 10/1980 | Morrison et al. | |
| 4,261,136 A | * | 4/1981 | Tsui | |
| 4,662,855 A | * | 5/1987 | Morrison | 446/227 |
| 4,868,564 A | * | 9/1989 | Falconer | 340/825.69 |
| 4,984,380 A | * | 1/1991 | Anderson | 40/455 |
| 5,041,048 A | * | 8/1991 | Lehmann et al. | 446/236 |
| 5,855,483 A | * | 1/1999 | Collins et al. | 434/322 |
| 5,951,360 A | * | 9/1999 | Fearon et al. | 446/227 |
| 6,113,455 A | * | 9/2000 | Whelan et al. | 446/227 |
| 6,116,983 A | | 9/2000 | Long et al. | 446/227 |
| 6,447,362 B2 | | 9/2002 | Khamphilavong et al. | 446/227 |
| 2003/0171065 A1 | * | 9/2003 | Greenberg | 446/226 |

FOREIGN PATENT DOCUMENTS

| | | | | |
|---|---|---|---|---|
| GB | 2239188 A | * | 6/1991 | A63H/33/00 |

* cited by examiner

*Primary Examiner*—Derris H. Banks
*Assistant Examiner*—Ali Abdelwahed
(74) *Attorney, Agent, or Firm*—Steins & Associates, P.C.

(57) ABSTRACT

An Infant-Operable Remote Controlled Entertainment and Education Device and System is disclosed. Also disclosed is a system that includes a control device that is safe to be left with unsupervised infants. The system further includes a responder device that is in communication with the control device. The control device has a plurality of buttons or other touch-sensitive portions dispersed on its face, and each of these buttons has a unique shape or design displayed thereon. Correspondingly, the responder device includes a plurality of figures or members that have shapes or display designs that correspond to the buttons on the control device. In operation, touching or pressing one of the control buttons or touch-sensitive portions of the control device will cause one of the figures or members on the responder device to animate or otherwise agitate in response. In view of the fascination that infants have with remote control devices, it is expected that the link between pressing a control device button and receiving a response from the responder device will provide an educational experience to the infant.

20 Claims, 7 Drawing Sheets

INFANT-OPERABLE REMOTE CONTROLLED ENTERTAINMENT AND EDUCATION DEVICE AND SYSTEM

BACKGROUND OF THE INVENTION

1. Field of the Invention

This invention relates generally to educational and entertainment devices and systems and, more specifically, to an Infant-Operable Remote Controlled Entertainment and Education Device and System 2. Description of Related Art The infant toy industry has exploded in recent years, particularly in the area of toys that are touted as working to stimulate the infant's developmental progression. While some of these toys may provide entertaining shapes, colors and even sounds for the infant, very few of them acknowledge an infant's ability to understand cause and effect, nor do they operate to build upon this naturally-occurring knowledge. What is needed, therefore is a device that uses feedback to teach an infant to recognize connections between shapes, colors and even sounds, and permits the infant to progress through the learning process safely without adult supervision.

Further, very young children are fascinated with the use of remote control devices. An infant is far more likely to play with a remote controlled toy and thereby learn associations of symbols on the remote with related responses on a physically separate base. This invention is intended to leverage off the fascination young children have with remotes in teaching shapes, sounds, movements and colors through associations made while using the remote.

SUMMARY OF THE INVENTION

In light of the aforementioned problems associated with the prior devices and systems, it is an object of the present invention to provide an Infant-Operable Remote Controlled Entertainment and Education Device and System. The system should include a control device that is safe to be left with unsupervised infants. The system should further include a responder device that is in communication with the control device. It is an object that the control device have a plurality of buttons or other touch-sensitive portions dispersed on its face, and that each of these buttons have a unique shape or design displayed thereon. Correspondingly, it is a further object that the remote device have a plurality of figures or members that have shapes or display designs that correspond to the buttons on the control device. In operation, touching or pressing one of the control buttons or touch-sensitive portions of the control device will cause one of the figures or members on the responder device to animate or otherwise agitate in response. In view of the fascination that infants have with remote control devices, it is expected that the link between pressing a control device button and receiving a response from the responder device will provide an educational experience to the infant.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an Infant-Operable Remote Controlled Entertainment and Education Device and System.

Figure 1:
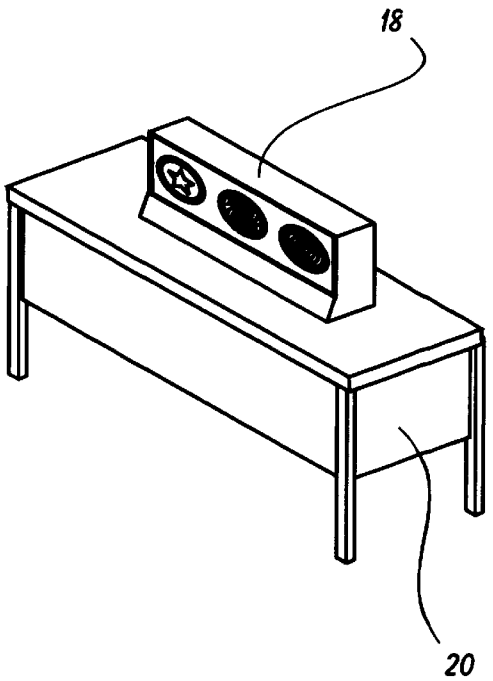
FIG. 1 is a perspective view of an infant interfacing with a preferred embodiment of the infant-operable entertainment system of the present invention.
Figure 1:
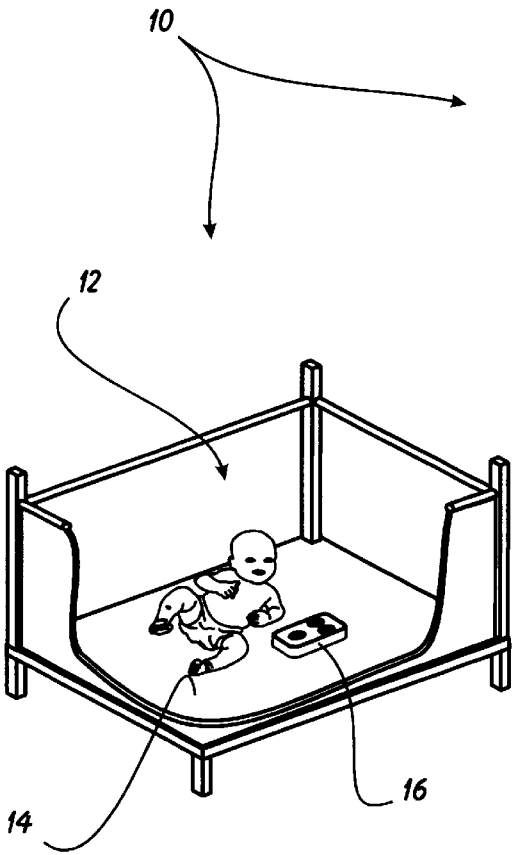

The present invention can best be understood by initial consideration of FIG. 1. FIG. 1 is a perspective view of an infant interfacing with a preferred embodiment of the infant-operable entertainment system 10 of the present invention. As depicted, the infant-operable entertainment system 10 comprises two major components: the control assembly 16 and the responder assembly 18. In the example shown, the infant 12, such as the one depicted as being in his play pen 14, will be able to reach and touch the control assembly 16. As will be discussed further below in connection with later drawing figures, the operation of the system 10 involves the infant user 12 touching or pressing particular portions or elements on the control assembly 16.

The responder assembly 18 has a communications link with the control assembly 16 that could be either wired or wireless in nature. When the infant user 12 depresses or touches certain portions of the control assembly 16, corresponding portions or elements of the responder assembly 18 will agitate (this term will be clarified later in this description). The type of agitation responses of the responder assembly 18 will depend upon what portion of the control assembly 16 is activated (i.e. touched or pressed), as well as what particular version of responder assembly 18 that is in use.

The assemblies 16 and 18 are designed with safety and durability in mind. For example, the control assembly 16 will conform to all safety guidelines and regulations necessary to permit the assembly 16 to be left with an unsupervised infant 12. The responder assembly 18 may be provided in a wide variety of shapes, sizes and configurations. The example here is configured to be placed on a table 20 or other flat surface within view of the infant 12; other designs may be configured to hang from the wall or otherwise attach to external structures. If we now turn to FIG. 2, we can examine a first example version of the present invention.

Figure 2:
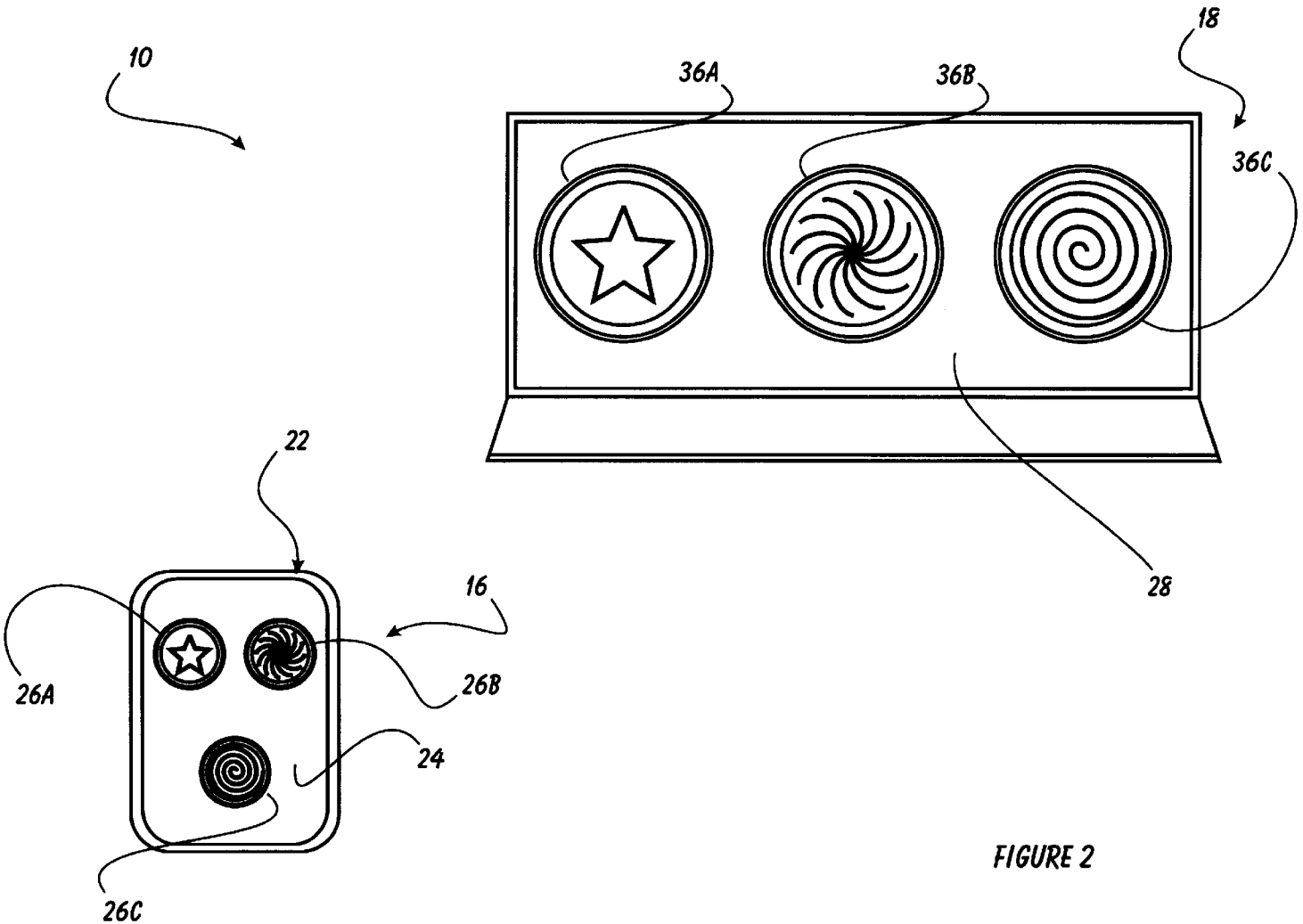
FIG. 2 is a front view of the embodiment of the infant-operable entertainment system of FIG. 1.

FIG. 2 is a front view of the embodiment of the infant-operable entertainment system 10 of FIG. 1. In this embodiment, the control assembly 16 comprises a base 22 further defined by a face 24. The base 22 may be configured to rest on the ground or in the infant's play pen, etc., or it may include apparatus to hang or otherwise attach the assembly 16 to the play pen, crib, etc.

Dispersed on the face 24 are a plurality of control means 26 for controlling a related responder module 36, namely first control means 26A, second control means 26B and third control means 26C. The control means 26 are buttons or other touch-sensitive areas or elements protruding through or dispersed on the face 24. In this example, it can be seen that each control means 26 has the same shape, however, each also has a unique diagram or design (indicia) displayed on it. Of course, an infinite selection of indicia is available, and those shown are simply exemplary. Furthermore, it might be desirable to enable the indicia and/or the buttons or touch pads to be removable and/or interchangeable with each other. That way, the adult can increase the infant's developmental progression by making changes in the locations and possibly designs of the indicia/buttons.

The responder assembly 18 comprises a housing 28, which as discussed above, may be configured to rest on a flat surface, or it may be set up for hanging or otherwise attaching to an external structure. In this embodiment, the assembly 18 comprises three responder modules 36, namely a first responder module 36A, and second responder module 36B and a third responder module 36C. As should be apparent, the design or indicia displayed on each responder module 36 directly corresponds to a substantially identical indicia or shape displayed on a control means 26. In operation, when the infant presses or touches the first control means 26A, the responder module displaying the similar indicia (the first responder module 36A) agitates. In this embodiment, the agitation of the responder modules 36 includes the illumination and/or spinning of the faces of the modules 36; in other embodiments, the agitation may comprise other actions.

It should be apparent from this operational description that the goal of the system 10 is to train the infant to recognize similarities and/or connections between two designs. If we now turn to FIG. 3, we can examine another embodiment of the present invention.

Figure 3:
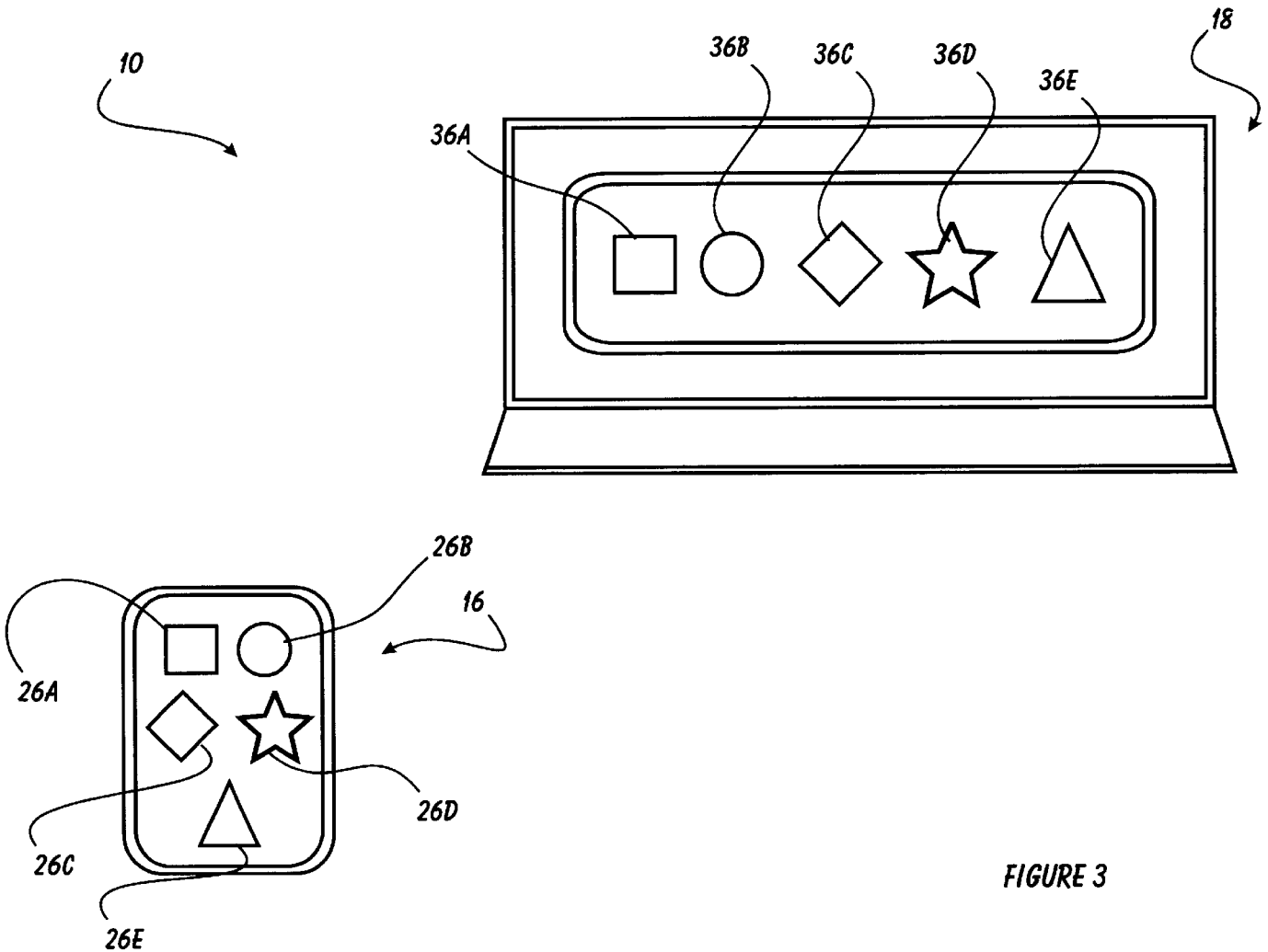
FIG. 3 is a front view of an alternate embodiment of the infant-operable entertainment system of the present invention.

FIG. 3 is a front view of an alternate embodiment of the infant-operable entertainment system 10 of the present invention. In this version, there are actually five control means 26 for controlling the responder modules 36; of course there is a corresponding number of responder modules 36 (i.e. five of them). Rather than having indicia displayed or inscribed on the control means 26, in this embodiment, the control means 26 are actually formed in different shapes. Similarly, the responder modules 36 have the same corresponding shapes. When the infant presses one of the shaped control means 26, the correspondingly-shaped responder module 36 will light up or pop out, or otherwise agitate. Any of these motions may be accompanied by a sound generated by the responder assembly 18 or one of the individual responder modules. Moving forward to FIG. 4, we can examine still another example.

Figure 4:
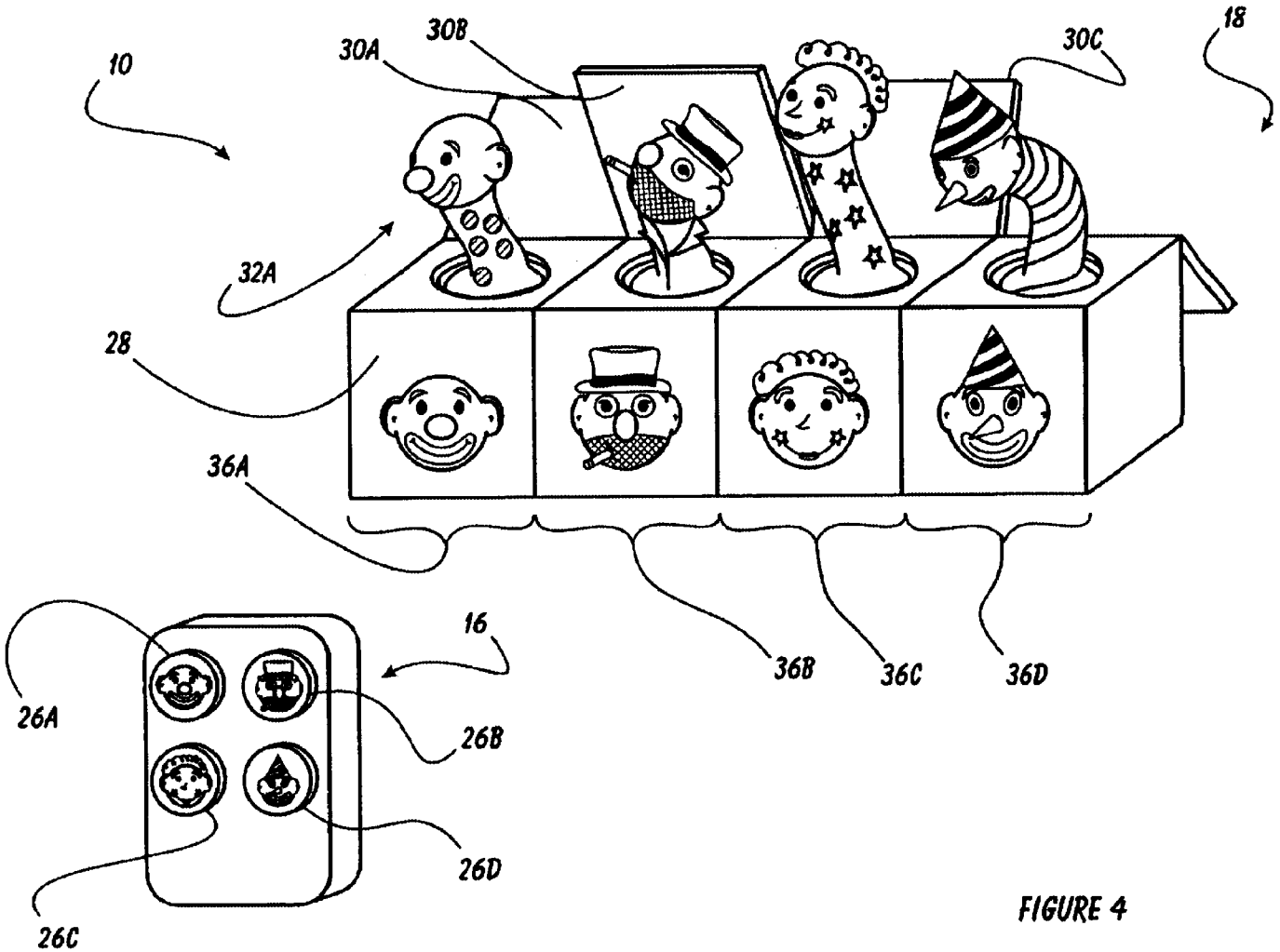
FIG. 4 is a front view of another alternate embodiment of the infant-operable entertainment system of the present invention.
Figure 5:
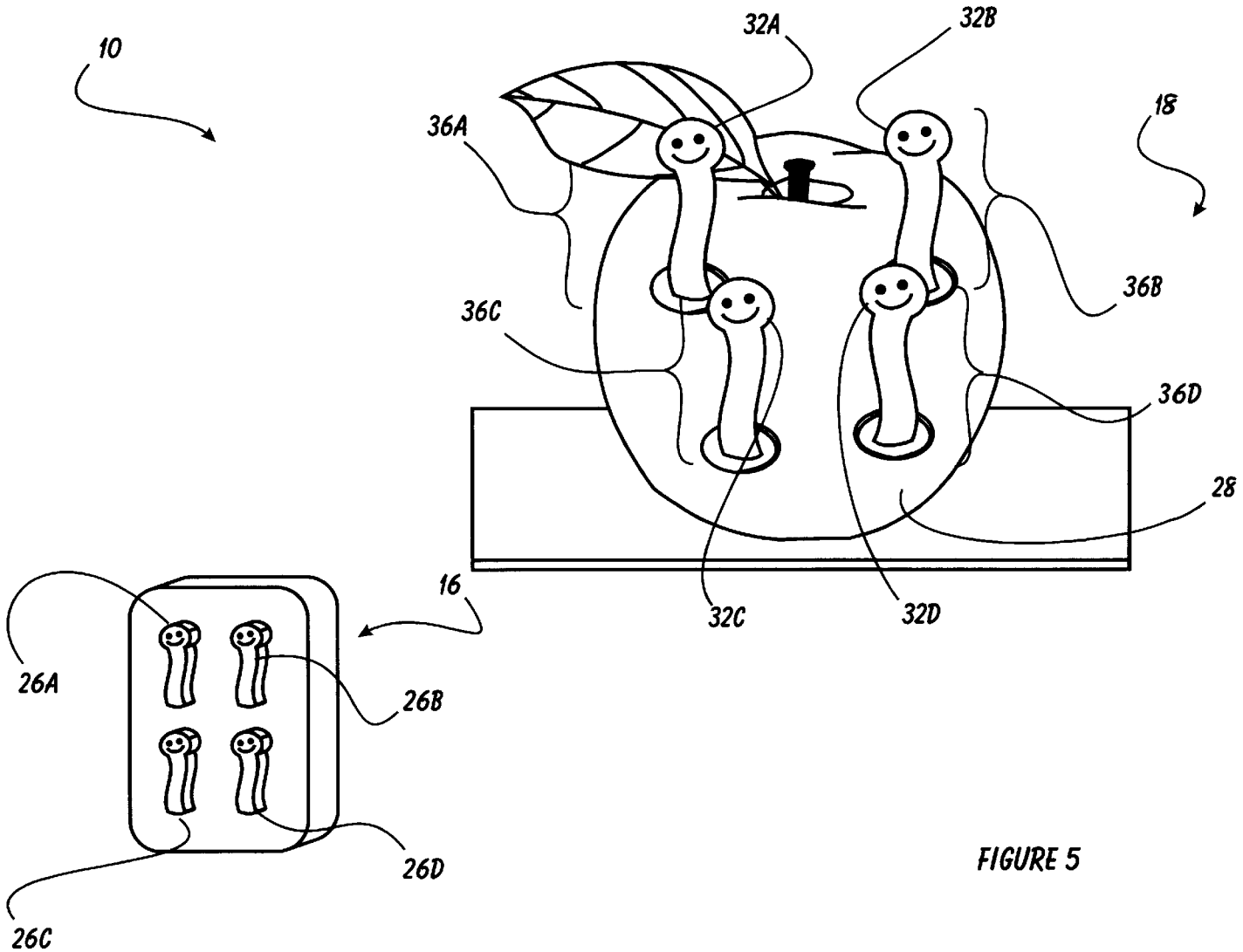
FIG. 5 is a front view of another alternate embodiment of the infant-operable entertainment system of the present invention.

FIG. 4 is a front view of another alternate embodiment of the infant-operable entertainment system 10 of the present invention. In this embodiment, the control means 26 each comprise indicia inscribed upon the button/pads. Each indicia corresponds to a three-dimensional figure 32 that pops up (like a "jack-in-the-box"), as well as the indicia inscribed on the front of the housing 28 adjacent to the matching three-dimensional figure 32. When the system is "at rest," the lids 30 are held in the closed position. When the infant presses or touches one of the control means 26, the lid covering the three-dimensional figure 32 that matches the indicia inscribed on the pressed control means 26 will release. When a lid 30 releases, the spring-loaded (or otherwise biased) three-dimensional figure 32 will be free to pop up. To reset the lid 30, a supervisor must simply press down on the lid 30 until it locks closed again. Turning to FIG. 5, we can review another novel design for the present system 10.

FIG. 5 is a front view of another alternate embodiment of the infant-operable entertainment system 10 of the present invention. As shown, the responder assembly 18 resembles an apple. Dispersed around the face of the apple are a plurality of apertures within which reside worm-shaped three-dimensional figures 32. Each of the figures 32 are preferably colored differently from the others.

The control assembly 16 has a plurality of control means 26 also in the shape of colored worms, each to correspond to individual unique three-dimensional figures 32. When the infant presses a particular control means 26, the figure 32 that has the corresponding color will pop out of its aperture, perhaps accompanied by a sound. The figure 32 will then return to its aperture, awaiting its control means 26 to be depressed or touched again. Another design example is depicted in FIG. 6.

Figure 6:
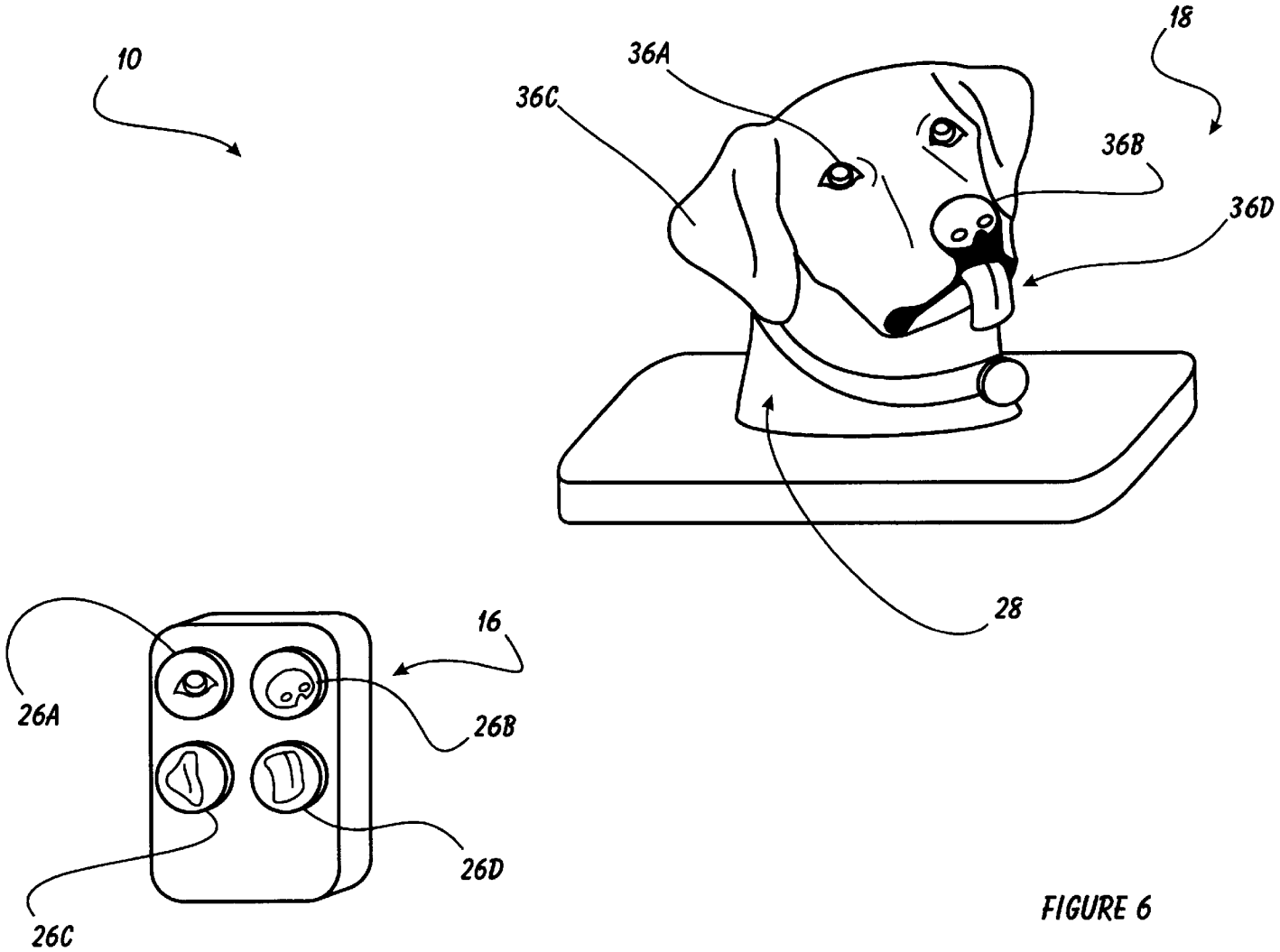
FIG. 6 is a front view of another alternate embodiment of the infant-operable entertainment system of the present invention.

FIG. 6 is a front view of another alternate embodiment of the infant-operable entertainment system 10 of the present invention. In this version, the responder assembly 18 (or a portion of it) is shaped like a dog's head—it should be apparent that a variety of animal shapes may be used in place of the dog. In this design, each responder module is a portion of the dog's anatomy, for example, the first responder module is an eye 36A; the second responder module 36B is the dog's nose; the third responder module 36C is an ear; and a fourth responder module 36D is the dog's tongue.

Correspondingly, the control assembly 16 has control means 26 with indicia that corresponds with each anatomical part of the dog. When the infant presses or touches a particular control means 26, the corresponding responder module will move and/or create a sound. The sounds may be unique to each control module, e.g. a barking noise when the tongue is pressed; a sniffing noise when the nose control means 26B is pressed, etc. Finally, turning to FIG. 7, we can examine yet another novel and nonobvious design.

Figure 7:
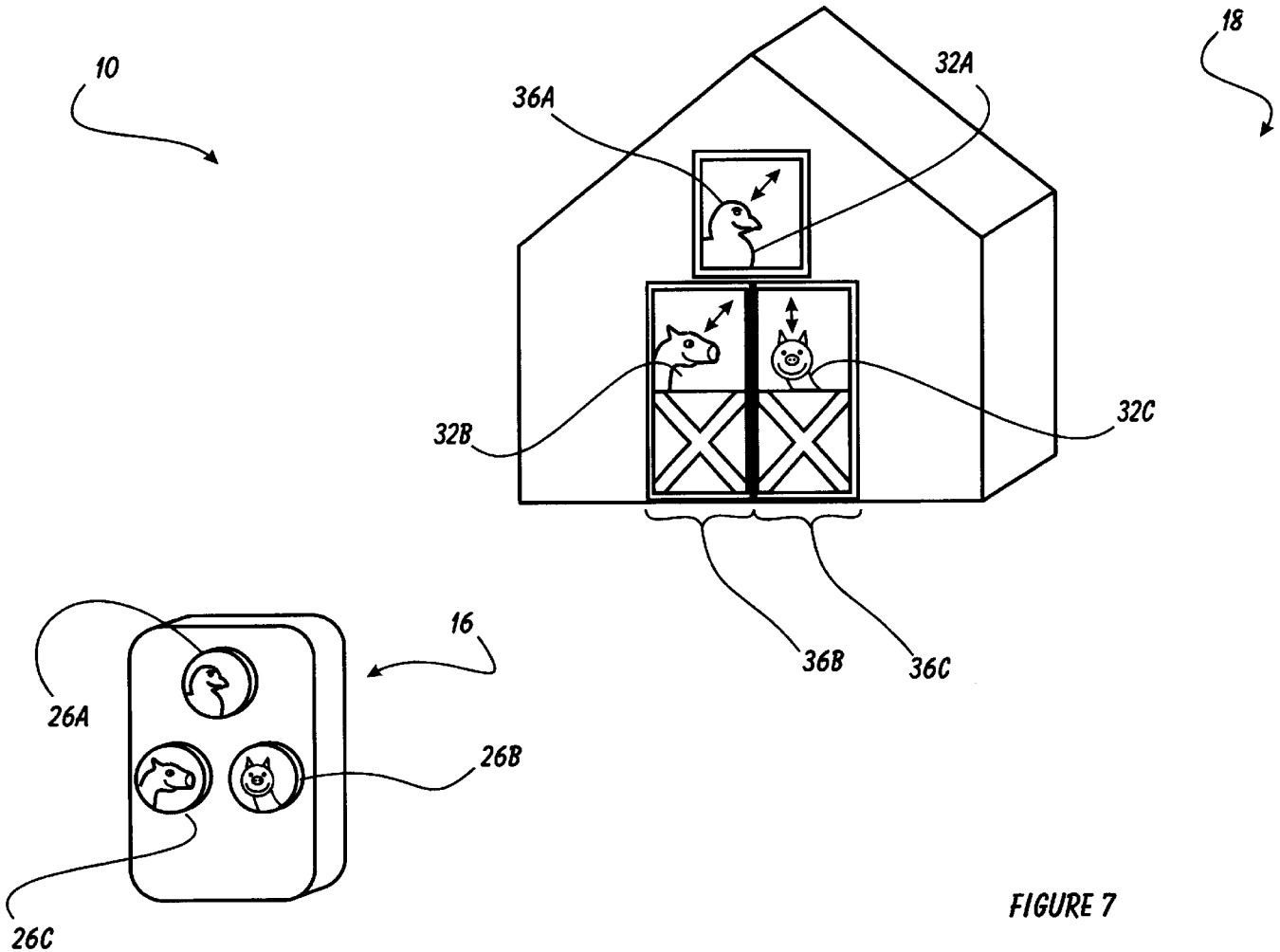
FIG. 7 is a front view of yet another alternate embodiment of the infant-operable entertainment system of the present invention.

FIG. 7 is a front view of yet another alternate embodiment of the infant-operable entertainment system 10 of the present invention. In this version, the responder assembly 18 is shaped similar to a barn, with a plurality of windows opening into it. Behind each window is an animated three-dimensional figure (or two-dimensional figure) in the shape of a farm animal. When the control means 26 that corresponds in shape or indicia to a particular animal figure 32 is pressed or touched, the animal figure 32 will move in front of, and back from the window in the barn. The responder assembly 18 may also emit a sound that is unique for each animal figure 32 when the corresponding control means 26 is depressed or touched.

The mechanical design for the apparatus described above will vary depending upon the particular embodiment's features. The control means 26 will be buttons, touch-sensitive pads, or other switches conventionally available. The responder modules 36 shall generate animation and/or lighting as is necessary to provide the desired attributes. The method of communication between the control assembly 16 and responder assembly 18 can be infrared, HF, laser or other wireless technology. Alternatively, the assemblies 16 and 18 may be wired together to transmit these control signals. Furthermore, although the control means 26 and responder modules 36 are treated above as if they were independent sub-systems, this is not an intended limitation. In fact, it may be desired that there is one central electronic "brain" in each assembly 16 and 18, and one central signal encoder and/or decoder in each, and one central mechanism for animating or otherwise agitating the individual responder module 36. They were discussed as being independent above simply to stress the attribute that one responder module 36 is linked in its control to a distinct control means 26.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An infant-operable entertainment system, comprising:

a responder assembly comprising a housing and a first responder module;

an infant-operable control assembly, configured for placement within reach of an infant for tactile interaction therewith by said infant, said control assembly comprising a base and a first control module, said control assembly in communication with said responder assembly; and whereby said control assembly to responder assembly communication causes said first responder module to agitate responsive to activation of said first control module, wherein said first control module comprises a first indicia displayed thereon and said first responder module further comprises said first indicia displayed thereon.

2. The system of claim 1, wherein said agitation comprises a light being illuminated.

3. The system of claim 1, wherein said agitation comprises movement of a three-dimensional figure.

4. The system of claim 1, wherein said responder assembly further comprises an audio output device, said audio output device configured to provide audible sounds responsive to activation of said first control module.

5. The system of claim 3, wherein said control assembly further comprises a second control module and said responder assembly further comprises a second responder module, whereby said control assembly to responder assembly communication causes said second responder module to agitate responsive to activation of said second control module.

6. The system of claim 5, wherein said control assembly further comprises a third control module and said responder assembly further comprises a third responder module, whereby said control assembly to responder assembly communication causes said third responder module to agitate responsive to activation of said third control module.

7. The system of claim 6, wherein said control assembly further comprises a fourth control module and said responder assembly further comprises a fourth responder module, whereby said control assembly to responder assembly communication causes said fourth responder module to agitate responsive to activation of said fourth control module.

8. The system of claim 3, wherein:

said three-dimensional figure defines a first shape; and said first indicia substantially depicts said first shape.

9. The system of claim 3, wherein:

said three-dimensional figure defines a first shape; and said first control module defines said first shape.

10. The system of claim 1, wherein said control assembly comprises a housing, said housing configured to be handheld by an infant.

11. The system of claim 1, wherein said control assembly contains multiple symbolically identifiable selections having appearances that are symbolically identifiable and distinct from one another, each said symbolically identifiable selection corresponding to a similar feature on said responder assembly defined by a similar appearance, each said responder assembly feature having said appearance that is distinct from said other responder assembly features comprising said responder assembly, whereby when said symbolically identifiable selection of said control assembly is activated, feedback is provided to an infant user via agitation of said responder assembly feature having a similar said appearance to said appearance of said activated symbolically identifiable selection.

12. An infant-operable entertainment system, comprising:

a responder assembly comprising a housing and a plurality of responder modules;

a control assembly comprising a base and a plurality of control modules, each said control module defining an appearance distinct from said other control modules comprising said control assembly, each said control module linked to one discrete said responder module, each said responder module further defining an appearance that is substantially similar to said appearance of one said control module, said responder module appearances being distinct from said other responder modules comprising said responder assembly, said control assembly in communication with said responder assembly and further configured to be safely tactilely interacted with by an unsupervised infant; and whereby said control assembly to responder assembly communication causes a said responder module to agitate responsive to activation of said control module to which said responder module is linked, and which activated control module has said appearance that is substantially similar to said appearance of said agitating responder module.

13. The system of claim 12, wherein one said control module comprises a star indicia displayed thereon and said linked responder module further comprises said star indicia displayed thereon.

14. The system of claim 12, wherein one said control module defines a star shape and said linked responder module defines said star shape.

15. The system of claim 12, wherein one said responder module comprises a pop-up figure defining a three-dimensional appearance and said linked control module displays indicia defining a two-dimensional appearance substantially representing said three-dimensional appearance of said pop-up figure.

16. The system of claim 12, wherein one said responder module comprises a worm-shaped three-dimensional figure defining a three-dimensional appearance and said linked control module displays indicia defining an appearance substantially representing said three-dimensional appearance of said worm-shaped figure; and said housing is further shaped substantially similar to an apple, said housing further defined by at least one aperture formed therein through which said worm-shaped three-dimensional figure can protrude responsive to activation of said linked control module.

17. The system of claim 12, wherein:

said housing is shaped substantially similar to a head of an animal;

one said responder module comprises an eye defining an appearance, said eye attached to said head; and said linked control module displays indicia substantially representing said appearance of said eye.

18. The system of claim 14, wherein said agitation comprises said star shape rotating.

19. The system of claim 1, wherein said agitation comprises said eye winking.

20. An infant-operable entertainment system, comprising:

a infant-operable control assembly comprising a first and second control module, said first control module displaying a first appearance and said second control module displaying a second appearance said control assembly further configured to be safely tactilely interacted with by an infant;

a responder assembly configured to communicate with said control assembly and further defined by a first responder module displaying said first appearance and a second responder module displaying said second appearance; and whereby activation of said first control module responsively causes said first responder module to agitate and activation of said second control module responsively causes said second responder module to agitate.

* * * * *